US006054970A

United States Patent [19]

Hirakawa et al.

[11] Patent Number: 6,054,970

[45] Date of Patent: Apr. 25, 2000

[54] METHOD FOR DRIVING AN AC-DRIVEN PDP

[75] Inventors: Hitoshi Hirakawa; Tetsuyoshi Tomioka, both of Kawasaki, Japan

[73] Assignee: Fujitsu Limited, Kawasaki, Japan

[21] Appl. No.: 09/017,669

[22] Filed: Feb. 3, 1998

[30] Foreign Application Priority Data

Aug. 22, 1997 [JP] Japan ..... 9-226088

[51] Int. Cl.[7] ..... G09G 3/28

[52] U.S. Cl. ..... 345/60; 345/66; 345/67

[58] Field of Search ..... 345/60, 66, 67, 345/61–63; 315/169.4; 313/581, 585

[56] References Cited

U.S. PATENT DOCUMENTS 5,420,602 5/1995 Kanazawa ..... 345/67
5,461,397 10/1995 Zhang et al. ..... 345/66
5,483,252 1/1996 Shigeta et al. ..... 345/67
5,583,527 12/1996 Fujisaki et al. ..... 345/60
5,790,087 8/1998 Shigeta et al. ..... 345/67
5,835,072 11/1998 Kanazawa ..... 345/60
5,874,932 2/1999 Nagaoka et al. ..... 345/60

*Primary Examiner*—Amare Mengistu
*Attorney, Agent, or Firm*—Staas & Halsey LLP

[57] ABSTRACT

A method for driving an AC-driven plasma display panel (PDP) having a three-electrode surface discharge structure constructed to have a first electrode and a second electrode both extending in a direction of a row line of elements arranged in matrix and a third electrode extending in a direction of a column line of the elements, the method including the step of applying, upon displaying images in time sequence, erase voltage pulses of different polarities for erasure to the second electrode and the third electrode so that an effective voltage exceeds an opposition discharge start voltage only in the case where a wall voltage of a predetermined value or higher is superposed on the voltage pulses, during a period from the end of sustaining the light-emission discharge for display for an image to the beginning of addressing for a next image.

10 Claims, 7 Drawing Sheets

METHOD FOR DRIVING AN AC-DRIVEN PDP

CROSS-REFERENCE TO RELATED APPLICATION

This application is related to Japanese application No. Hei 9(1997)-226088, filed on Aug. 22, 1997 whose priority is claimed under 35 USC § 119, the disclosure of which is incorporated by reference in its entirety.

BACKGROUND OF THE INVENTION

1. Field of the Invention

The present invention relates to a method for driving an AC driven plasma display panel (PDP) performing matrix display by a surface electric discharge along a screen.

2. Description of Related Art

The PDP is a flat display device of a self-luminous type, having a pair of substrates as a support. Since a PDP capable of color display was put to practical use, the PDP has wider applications, for example, as a display of television pictures or a monitor of a computer. The PDP is now attracting attention also as a large, flat display device for high-definition TV.

In the PDP using a matrix display system, a memory effect is employed for sustaining a light-emitting state of cells which are display elements. The AC-driven PDP is so constructed to structurally have a memory function by means of a dielectric layer covering electrodes. For displaying an image by the AC-driven PDP, sequential addressing is carried out line by line to select and charge only cells which are to emit light, and then a sustain voltage of alternating polarity for sustaining a light-emitting state, i.e., for sustaining repeated light-emission discharges for display, is applied to all cells simultaneously. The sustain voltage is a predetermined voltage which is lower than a firing voltage, i.e., a discharge start voltage. In a cell having wall charge, the wall charge is superposed on the sustain voltage to form an effective voltage which is actually applied to the cell. When the effective voltage exceeds the firing voltage, an electric discharge takes place and the cell emits light. If the sustain voltage is repeatedly applied at a short cycle, apparently continuous light emission can be obtained. Luminance of display depends on "integrated luminescence intensity" which is the total amount of light emitted during a sustain period for sustaining the light-emission discharges. Usually, the frequency of a sustain voltage pulse which determines a discharge cycle is constant. Therefore the length of the sustain period, i.e., the number of discharges, s set depending on an intended luminance.

As color display devices, AC-driven PDPs of a surface discharge type have become commercial. The surface discharge type is a system wherein pairs of main electrodes, i.e., pairs of first and second electrodes, which alternately become positive or negative for sustaining the light-emission discharges, are arranged in parallel on one of a pair of substrates. Since the main electrodes extend in the same direction, third electrodes intersecting the main electrodes need to be provided for selecting individual cells. The third electrodes are disposed on the other substrate in an opposing relation to the main electrodes with a discharge gas space therebetween in order to reduce electrostatic capacity of the cells. An electric discharge is generated for addressing across one of the main electrodes and the third electrode. In such PDPs having a three-electrode structure, fluorescent layers for color display can be provided on the other substrate opposite to the substrate on which the main electrodes are placed, in order to reduce deterioration of the fluorescent layers by ion impact at electric discharges and to increase the life of the devices. Such a display panel having the fluorescent layers on a rear substrate is called a "reflection type" PDP. On the other hand, a display panel having the fluorescent layers on a front substrate is called a "transmission type" PDP. The reflection type, in which front surfaces of the fluorescent layers emit light, is more excellent in luminous efficiency.

For displaying images, i.e., frames, in time sequence by the AC-driven PDP in which the light-emission discharge is maintained using wall charge as described above, initialization (reset) is carried out to make the entire screen non-charged, during a time period from the end of sustaining the light-emission discharges for a certain image to the beginning of the addressing for the following image. Methods for this initialization fall roughly into two categories: One is to generate a surface discharge regardless of the presence of wall charge. For example, a reset pulse whose crest value is higher enough than a surface discharge start voltage is applied simultaneously to the main electrodes of all cells. A strong discharge occurs at the building-up of the reset pulse, and more wall charge is generated than is generated at the sustaining of the light-emission discharges. Accordingly, the wall voltage cancels the applied voltage and the effective voltage decreases. When the reset pulse falls, the wall voltage remains as the effective voltage, and a self discharge occurs to eliminate the wall charge. The other one is to generate a surface discharge only in cells having wall charge, i.e., cells having been activated to emit light for display in the immediately preceding display.

For the former, conventionally, the initialization is carried out by applying to the main electrodes of all cells simultaneously, a voltage pulse whose pulse width is shorter than that of the voltage for sustaining the light-emission discharges, a voltage pulse whose crest value is a little lower than that of the sustain voltage or a voltage pulse whose voltage gradually rises. In the case where the pulse width is short, new charge by electrostatic attraction is not generated after the wall charge is eliminated by the surface discharge. In the case where the crest value is low, the surface discharge is weak and the new charge is insignificant. In the case where the voltage rises gradually, a relatively weak discharge occurs when the voltage reaches the surface discharge start voltage.

However, where the surface discharge is generated in all the cells for the initialization, the contrast of display drops because the entire screen emits light every time when display is changed. Especially, in the case where the frame is divided for performing gradation display, the contrast falls remarkably since a plurality of changes of display are carried out in one frame.

On the other hand, where the surface discharge is generated only in the cells having wall charge, a particular voltage is applied to the main electrodes for generating the surface discharge. Therefore, if relatively large wall charge is present near the third electrodes, a complete initialization cannot be obtained and there remains difference in discharge probability after the initialization between the cells having been activated in the immediately preceding display and the other cells. For these reasons, a voltage margin of addressing is narrow and stable display can hardly be realized.

SUMMARY OF THE INVENTION

An object of the present invention is to form a completely non-charged state in an AC-driven plasma display panel without emission of light all over the screen prior to addressing for stable display.

The present invention provides a method for driving an AC-driven plasma display panel (PDP) having a three-electrode surface discharge structure constructed to have a first electrode and a second electrode both extending in a direction of a row line of elements arranged in matrix and a third electrode extending in a direction of a column line of the elements, the third electrode being opposed to the first electrode and second electrode with a discharge gas space therebetween, the second electrode and the third electrode being used for addressing, the first electrode and the second electrode being used for sustaining a light-emission discharge for display, the method comprising the step of applying, upon displaying images in time sequence, erase voltage pulses of different polarities for erasure to the second electrode and the third electrode so that an effective voltage exceeds an opposition discharge start voltage only in the case where a wall voltage of a predetermined value or higher is superposed on the voltage pulses, during a period from the end of sustaining the light-emission discharge for display for an image to the beginning of addressing for a next image.

DESCRIPTION OF THE PREFERRED EMBODIMENTS

Figure 1:
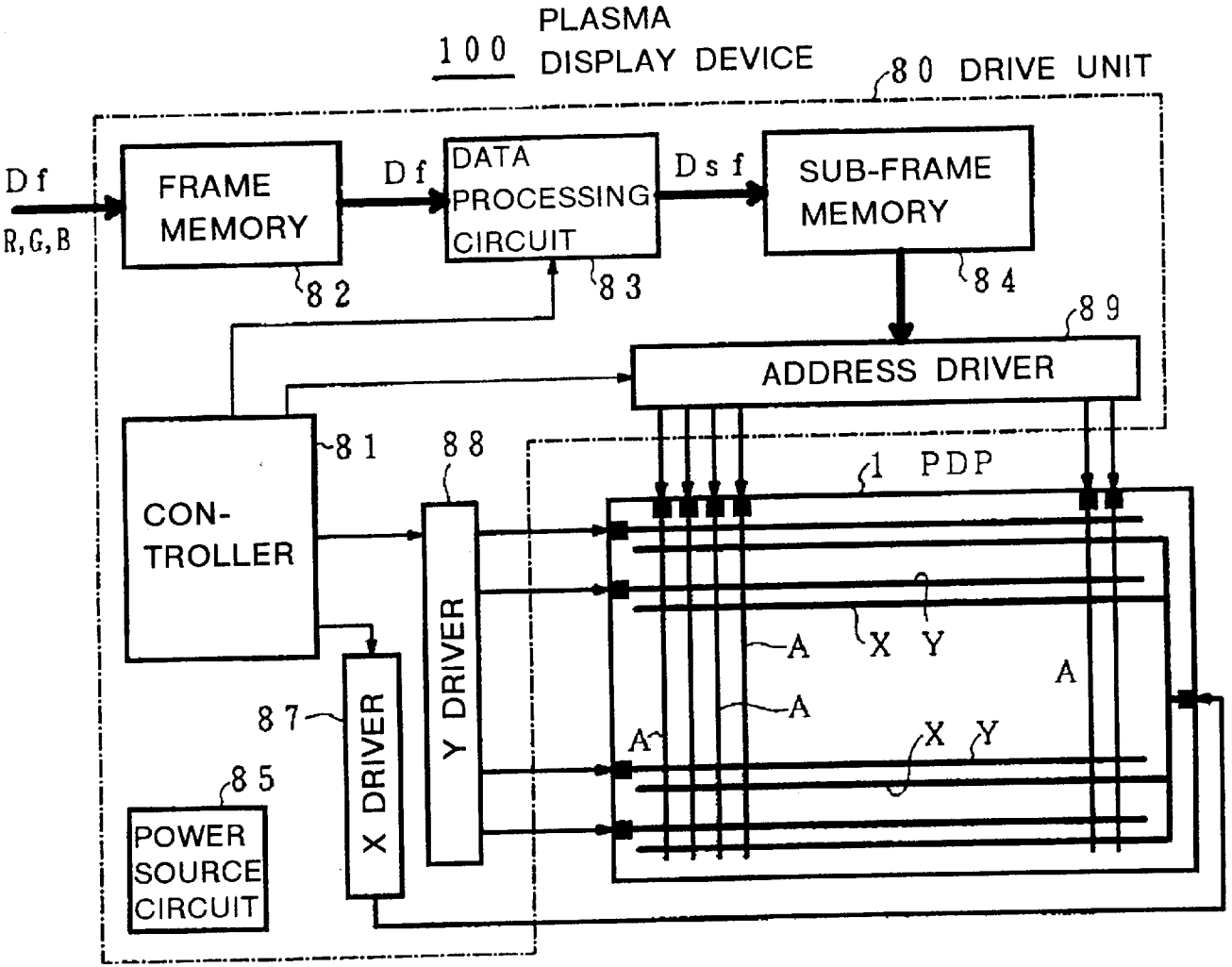
FIG. 1 is a diagram illustrating the structure of a plasma display in accordance with the present invention.

In the present invention, the third electrodes are positively utilized for the initialization prior to the addressing to initialize charge distribution. More particularly, an opposition electric discharge is generated in a direction of the thickness of a panel across one of the main electrodes, i.e., the second electrode, and the third electrode. A voltage applied at this time is set such that the opposition discharge is generated only in cells having residual wall charge and then the generated opposition discharge proceeds to a surface discharge across the main electrodes. The surface discharge is less easily generated than the opposition discharge, but when the opposition discharge takes place, the surface discharge is induced by priming effect of the opposition discharge. Not all the electrodes are required to be biased. The opposition discharge and the surface discharge sometimes happen if the first electrodes are maintained at a ground potential and only the second and third electrodes are biased. The generation of the opposition discharge can also eliminate charge remaining near the third electrodes unlike the conventional case where only the surface discharge is generated.

In the present invention, the second electrode may be used as a scanning electrode to select the elements row by row and the third electrode may be used as a data electrode to select the elements column by column.

A voltage pulse which is the same as a sustain voltage pulse for sustaining the light-emission discharge for display may be applied across the first electrode and the second electrode to generate at least one surface discharge prior to the application of the erase voltage pulses during said period.

Further, the at least one surface discharge may be generated by, immediately before the application of the erase voltage pulse to the second electrode, applying to the second electrode the same voltage pulse as the sustain of a polarity opposite to the erase voltage pulse.

After the same voltage pulse as the sustain voltage pulse is applied, the potential of the second electrode may gradually be shifted from a potential biased by the application of the voltage pulse to a potential biased by the application of the erase voltage pulse.

At the same time as the erase voltage pulses are applied to the second electrode and the third electrode, an erase voltage pulse of the same polarity as that of the voltage pulse applied to the third electrode may be applied for erasure to the first electrode.

In this case, the erase voltage pulse applied to the first electrode may have a crest value of 0 to 60 volts, the erase voltage pulse applied to the second electrode may have a crest value of −20 to −100 volts, and the erase voltage pulse applied to the third electrode may have a crest value of 40 to 140 volts.

The display screen may be divided into a plurality of areas in the direction of the column and the application of the erase voltage pulses to the second electrode and the third electrode may be carried out area by area.

In each of the areas, the application of the erase voltage pulses to the second electrode and the third electrode may be directly followed by addressing.

The crest value of the erase voltage pulse applied to the second electrode may be equal to a voltage applied to the second electrode on a non-selected line in the addressing, and the crest value of the erase voltage pulse applied to the third electrode may be equal to a voltage applied to the third electrode in the addressing.

EXAMPLES

FIG. 1 illustrates the structure of a plasma display 100 in accordance with the present invention.

The plasma display 100 includes an AC-driven PDP 1 which is a color display device utilizing a matrix system and a drive unit 80 for selectively lighting a large number of cells which compose a screen. The plasma display 100 can be used as a television receiver or a monitor of a computer.

The PDP 1 is a three-electrode surface discharge PDP in which pairs of sustain electrodes X and Y are disposed in parallel as the first and second (main) electrodes and define cells as display elements at intersections with address electrodes A as the third electrodes. The sustain electrodes X and Y extend in the direction of rows, i.e., in the horizontal direction, on the screen. The sustain electrodes Y are used as scanning electrodes to select cells row by row in addressing. The address electrodes A extend in the direction of columes, i.e., in the vertical direction, on the screen and are used as data electrodes to select cells column by column in the addressing. An area where the sustain electrodes intersect the address electrodes is a display area, that is, a screen.

The drive unit 80 includes a controller 81, a frame memory 82, a data processing circuit 83, a sub-frame memory 84, a power source circuit 85, an X driver 87, a Y driver 88 and an address driver 89. Frame data Df are inputted to the drive unit 80 together with various synchronizing signals. The frame date Df are representative of luminance levels, i.e., gradation levels, for individual colors R, G and B and determine the color of pixels.

The frame data Df are stored in the frame memory 82 and then transferred to the data processing circuit 83. The data processing circuit 83 is data converting means for setting combination of sub-frames in which the cells are activated to emit light and outputs sub-frame data Dsf in accordance with the frame data Df. The sub-frame data Dsf are stored in the sub-frame memory 84. Each bit of the sub-frame data Dsf has a value representing whether or not a cell must emit light in a sub-frame.

The X driver circuit 87 applies a driving voltage to the sustain electrodes X and the Y driver circuit 88 applies a driving voltage to the sustain electrodes Y. The address driver circuit 89 applies a driving voltage to the address electrodes A according to the sub-frame data Dsf.

Figure 2:
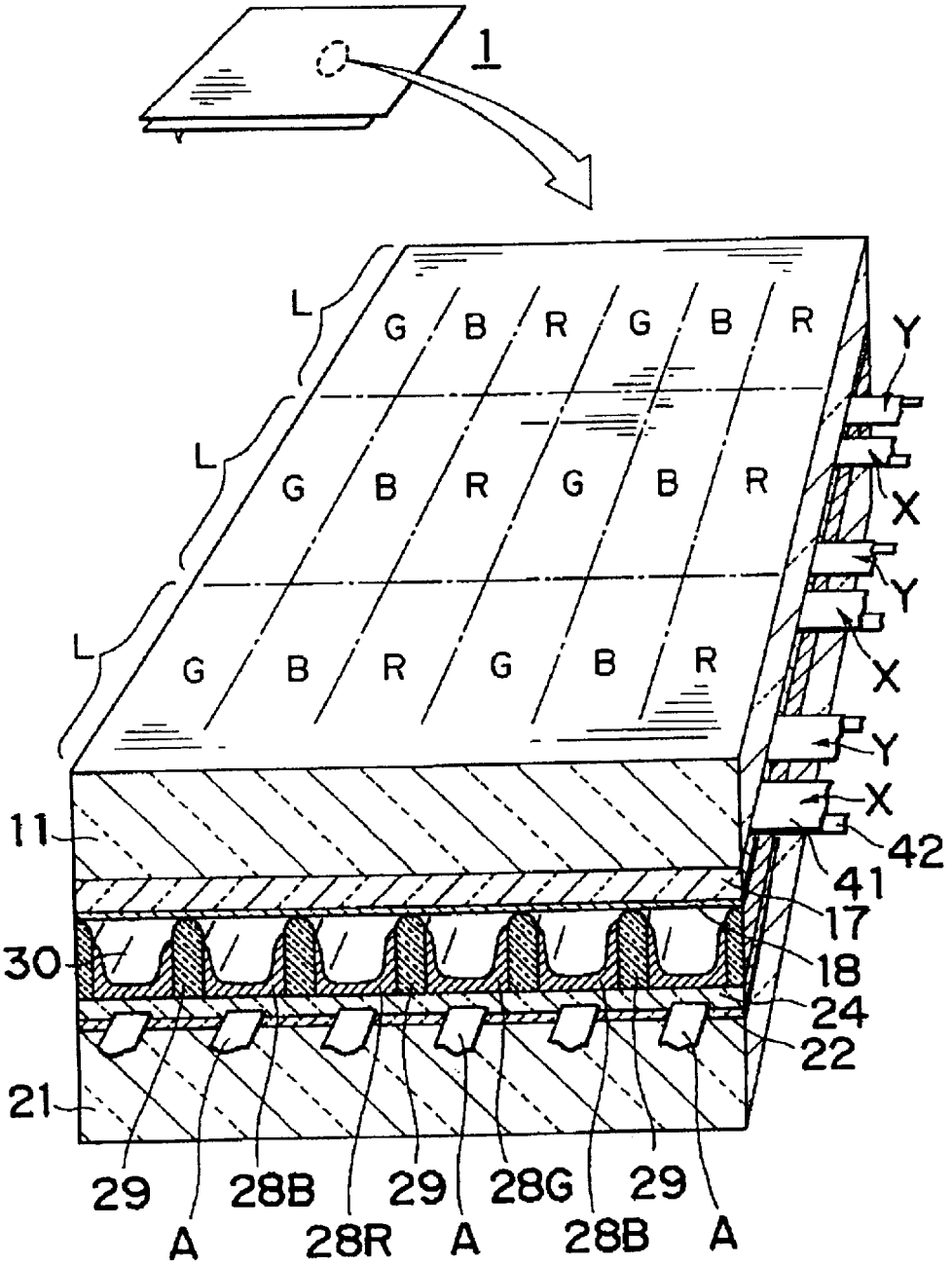
FIG. 2 is a perspective view illustrating the inner construction of a PDP in accordance with the present invention.

FIG. 2 is a perspective view illustrating the inner construction of the PDP 1.

In the PDP 1, a pair of sustain electrode X and Y is disposed on each of the rows of cells in the horizontal direction on the matrix screen on an inside surface of a glass substrate 11. Each of the sustain electrodes X and Y includes a electrically conductive transparent film 41 and a metal film (bus conductor) 42 and is covered with a dielectric layer 17 of 30 $\mu$m in thickness of a low-melting glass. A protection film 18 of magnesia (MgO) of several thousand A in thickness is formed on a surface of the dielectric layer 17. The address electrode A is disposed on a base layer 22 which covers an inside surface of a glass substrate 21. The address electrode A is covered with a dielectric layer 24 of about 10 $\mu$m in thickness. On the dielectric layer 24, ribs 29 of about 150 $\mu$m in height in the form of a linear band in a plan view are each disposed between the address electrodes A. These ribs 29 partition a discharge space 30 into sub-pixels, i.e., light-emitting units, in the direction of the line and also define a spacing for the discharge space. Fluorescent layers 28R, 28G and 28B of three colors R, G and B for color display are formed to cover surfaces above the address electrodes and side walls of the ribs 29. The ribs are preferably colored dark on the top portions and white in the other portions to reflect visible light well for improving contrast. The ribs can be colored by adding pigments of intended colors to a glass paste which is a material for the ribs.

The discharge space 30 is filled with a discharge gas of neon as the main component with which xenon is mixed (the pressure in the discharge space is about 500 Torr). The fluorescent layers 28R, 28G and 28B are locally excited by ultraviolet rays irradiated by xenon to emit light when electric discharge takes place. One pixel for display is composed of three sub-pixels adjacently placed in the direction of the row. The sub-pixels in each of the columns emit light of the same color. The structural unit in each of the sub-pixels is the cell C (see FIG. 4). Since the ribs 29 are arranged in a stripe pattern, portions of the discharge space 3 which correspond to the individual columns are vertically continuous, bridging all the rows. For this reason, the gap between the electrodes in adjacent rows (referred to as a reverse slit) is set to be sufficiently larger than a gap to allow the surface discharge in each of the rows (e.g., 80 to 140ηm), in order to prevent coupling by an electric discharge between cells in a column, for example, about 400 to 500 $\mu$m. Additionally, for the purpose of covering fluorescent layers in the reverse slits, which do not emit light and look white, light-tight films are provided on the outer or inner surface of the glass substrate 11 corresponding to the reverse slits.

It is now explained how the PDP 1 of the plasma display 1 is driven.

Figure 3:
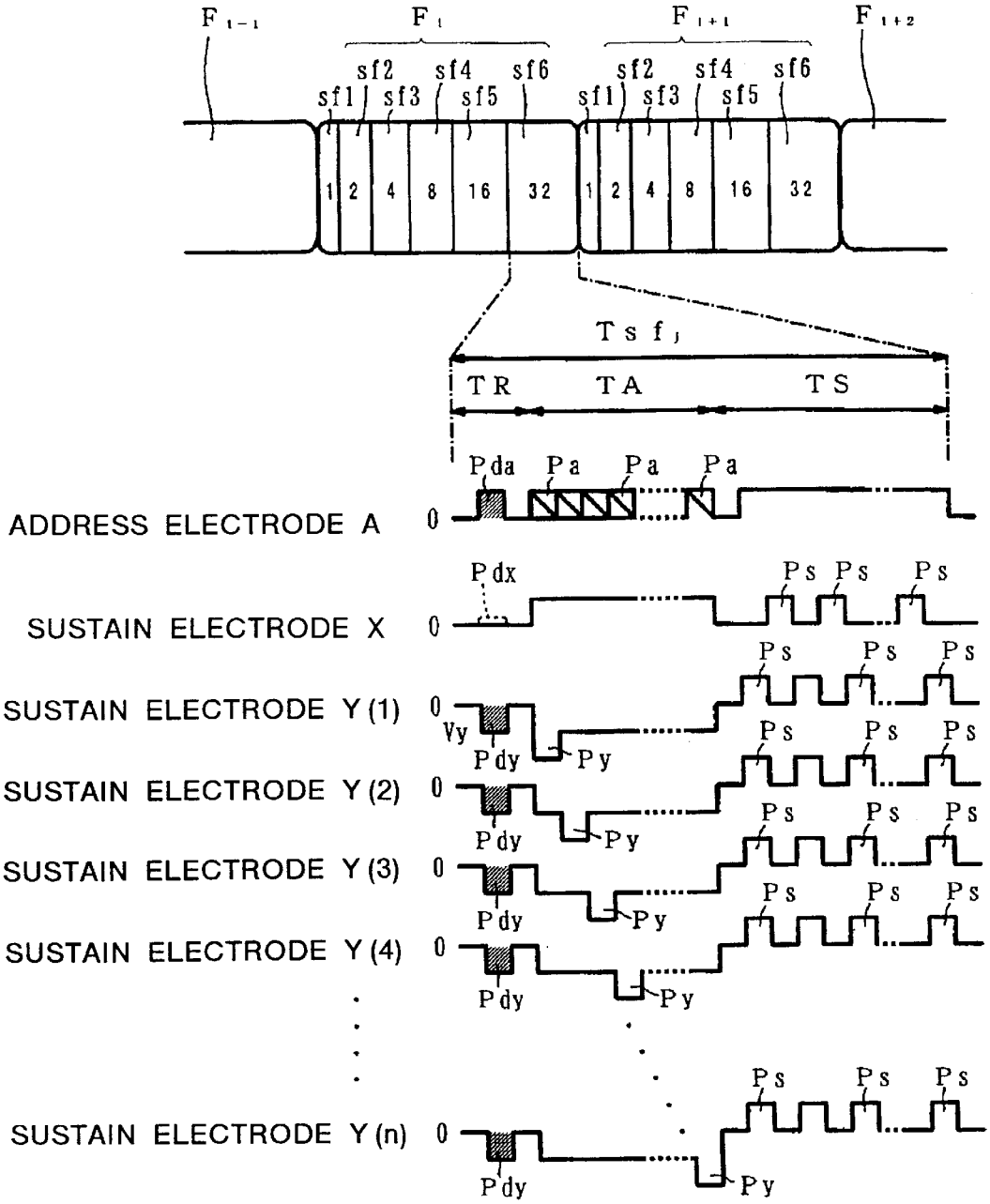
FIG. 3 is a schematic view outlining a frame structure and a drive sequence in accordance with the present invention.

FIG. 3 is a schematic view outlining a frame structure and a drive sequence.

For reproducing color gradation by binary control of lighting with the PDP1, each frame F which is an image inputted in time sequence is divided into, for example, six sequential sub-frames sf1, sf2, sf3, sf4, sf5 and sf6 as conventionally divided. The numbers of light emissions in the sub-frames sf1 to sf6 are set to provide weighted luminance for the sub-frames so that the relative ratio of luminance of the sub-frames sf1 to sf6is 1:2:4:8 16:32. The luminance in the frame can be set to 64 levels, "0" to "63," for each of the colors R, G and B by changing combination of lighting or non-lighting in the sub-frames. Thus $64^3$ colors can be displayed. The sub-frames sf1 to sf6 need not be displayed in ascending order of the weight of luminance. The order can be optimized, for example, by putting the sub-frame sf6 having the largest weight of luminance in the middle of a period of the frame.

A reset period TR, an address period TA and a sustain period Ts are provided for each of the sub-frames sf1 to sf6. In other words, the sub-frame is provided with a period Tsf for display which includes the three periods TR, TA and TS. The lengths of the reset period TR and the address period TA are constant in all the sub-frames independently of the weights of luminance, while the length of the sustain period TS is longer for a sub-frame which has a larger weight of luminance. Thus, the periods of the sub-frames differ. The address period TA must be directly before the sustain period TS, but the reset period TR may be before the address period TA or after the sustain period TS.

The reset period TR is a period for initializing a charged state on the entire screen, i.e., erasing wall charge in all the cells, in order to eliminate effect of a light-emitting state in a preceding sub-frame, by a method specific to the present invention. Here, for example, if the initialization is carried out before the addressing in a j-th sub-frame, the initialization is a pretreatment to prevent the j-th sub-frame from being affected by the effect of the preceding (j−1)-th sub-frame. If the initialization is carried out after the sustaining of the light-emission discharges, the initialization is a post-treatment to prevent the effect of the j-th sub-frame from affecting the next (j+1)-th sub-frame.

The outline of the initialization is as follows. A reset pulse Pda of a first polarity (positive in this example) is applied to all the address electrodes A. At the same time, a reset pulse Pdy of a second polarity (negative in this example) is applied to sustain electrodes Y in a number of rows depending on a drive capacity of the address driver 89. According to the present invention, the crest values of the reset pulses Pda and Pdy as the erase voltage pulses are set such that the voltage present across the address electrode A and the sustain electrode Y together with the superposed wall charge slightly exceeds an opposition discharge starting voltage $Vf_{AY}$. A cell in which light-emission discharges have been sustained in the preceding sub-frame (referred to as a "precedingly selected cell") retains the wall charge formed in the last surface discharge. For this reason, the application of the reset pulses Pda and Pdy causes an opposition discharge which has a priming effect of inducing a surface discharge, in the precedingly selected cell. If the crest values of the reset pulses Pda and Pdy are properly selected, the surface discharge finishes when the remaining wall charge is neutralized to disappear, and new wall charge is not formed or, if formed, is extremely insignificant. In this case, since the opposition discharge is generated as a trigger for the surface discharge, residual charge around the address electrode A also disappears. Therefore, the precedingly selected cell falls in a substantially non-charged state. Since a cell which has not emitted light in the preceding sub-frame is in the non-charged state, all the cells of the entire screen become in the non-charged state by the initialization. In such initialization, a reset pulse Pdx of a first polarity may be applied to the sustain electrode X at the same time as the reset pulses Pda and Pdy are applied for optimizing a balance in inducibility of the opposition discharge and the surface discharge.

The address period TA is a period for addressing, i.e., setting of lighting/non-lighting, by a writing method of selectively charging only cells which are to be activated to emit light for display from the initialized state or by a erasing method of charging all the cells on the entire screen and then selectively returning only cells which are not to emit light to the non-charged state. The example shown in the figure is of the writing method. The sustain electrodes X are biased to a potential of the first polarity with respect to the ground potential and all the sustain electrodes Y are biased to a potential of the second polarity. In this state, the rows are sequentially selected one by one from the first row, and a scan pulse Py of the second polarity is applied to the sustain electrode Y on a selected row. At the same time as the selection of the rows, an address pulse Pa of the first polarity is applied to an address electrode A corresponding to a cell to emit light. In the cell on the selected row to which the address pulse Pa is applied, the opposition discharge is generated across the sustain electrode Y and the address electrode A to form wall charge on the dielectric layer 17. Thus the opposition discharge proceeds to the surface discharge. This series of discharges is an address discharge. Since the sustain electrode X is biased to the same polarity as that of the address pulse Pa, this bias cancels the address pulse Pa and therefore discharge does not take place across the sustain electrode X and the address electrode A.

The sustain period TS is a period for sustaining the light-emission state established in the address period to ensure luminance in accordance with a desired gradation level. In order to prevent an unnecessary discharge, all the address electrodes A are biased to a potential of the first polarity, and a sustain pulse Ps of the first polarity is applied to all the sustain electrodes Y. Then the sustain pulse Ps is applied to the sustain electrodes X and Y alternately. Every time when the sustain pulse Ps is applied, the surface discharge takes place in cells in which the wall charge is formed in the address period TA. The sustain pulse Ps is applied at a regular cycle. The number of applications of the sustain pulse Ps is set according to the weight of luminance assigned to the sub-frame.

Figure 4:
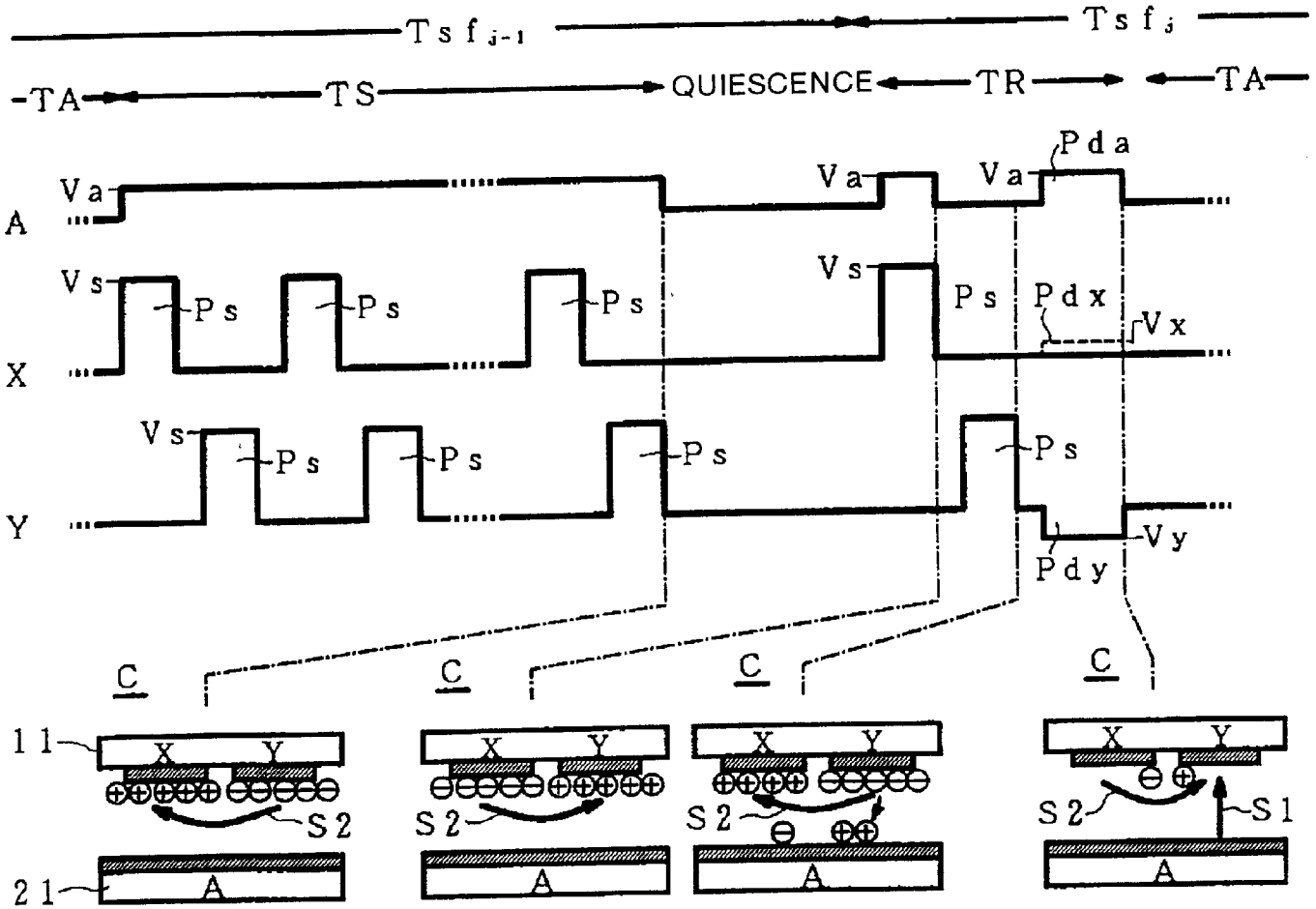
FIG. 4 explains relationship between applied voltages and charged states in initialization in accordance with the present invention.

FIG. 4 explains relationship between applied voltages and charged states in the initialization.

For the initialization, the discharge is generated only in the precedingly selected cells using the wall charge. For this purpose, the wall charge must exist in a proper amount in the precedingly selected cells when the reset pulses Pda and Pdy are applied. If a hold period (non-biasing period) between the sustain period TS and the reset period TR is long, it is effective to apply a pulse which is the same as the sustain pulse Ps (hereinafter this pulse is also referred to as sustain pulse for simplicity) immediately before the application of the reset pulses Pda and Pdy to generate a surface discharge of appropriate intensity.

In the example shown in FIG. 4, the last sustain pulse Ps in the sustain period TS is applied to the sustain electrodes Y. Accordingly, at the ending of the sustain period TS, the wall charge of the first polarity is formed near the sustain electrodes X and the wall charge of the second polarity is formed near the sustain electrodes Y. After that, as the hold period passes, the amount of the wall charge sometimes decreases gradually.

In view of this, the sustain pulse Ps is first applied to the sustain electrodes X in the initialization to generate a surface discharge S2. At this time, all the address electrodes A are biased to a potential Va of the first polarity for preventing an unnecessary discharge as in the sustain period Ts. The surface discharge S2 reverses the polarities of the wall charge near the sustain electrodes X and Y.

Then, for forming wall voltages which suit with the polarities of the reset pulses Pda and Pdy, the sustain pulse Ps is applied to the sustain electrodes Y to generate the surface discharge S2 in order to reverse the polarity of the wall charge. At this time, for forming, on the surface of the dielectric layer on the rear substrate opposing to the sustain electrodes Y, wall charge of the same polarity as the reset pulse Pda that is applied to the address electrode A, the address electrodes A are kept at a ground potential (GND). After the preparation of charge distribution by these two surface discharges, the reset pulses Pda, Pdx and Pdy are applied to generate the opposition discharge S1 and the surface discharge S2 for the initialization of the charge distribution on the screen, as described above. Table 1 shows ranges of crest values of the reset and sustain pulses as practically used.

TABLE 1

| Pulses | Range of Crest Value Practically Used |
|---|---|
| Reset Pulse Pdx (applied to the first electrode) | 0 ~ 60 V |
| Reset Pulse Pdy (applied to the second electrode) | −20 ~ −100 V |
| Reset Pulse Pda (applied to the third electrode) | 40 ~ 140 V |
| Sustain Pulse | 150 ~ 180 V |

If the crest value of the reset pulse Pda is equal to the bias potential Va of the address electrodes A in the sustain period TS, the power source circuit 85 can be simplified. Alternatively, the power source circuit 85 can be simplified by setting the crest value of the reset pulse Pdy equal to the bias potential of sustain electrodes Y in non-selected rows L in the address period TA.

Figure 5:
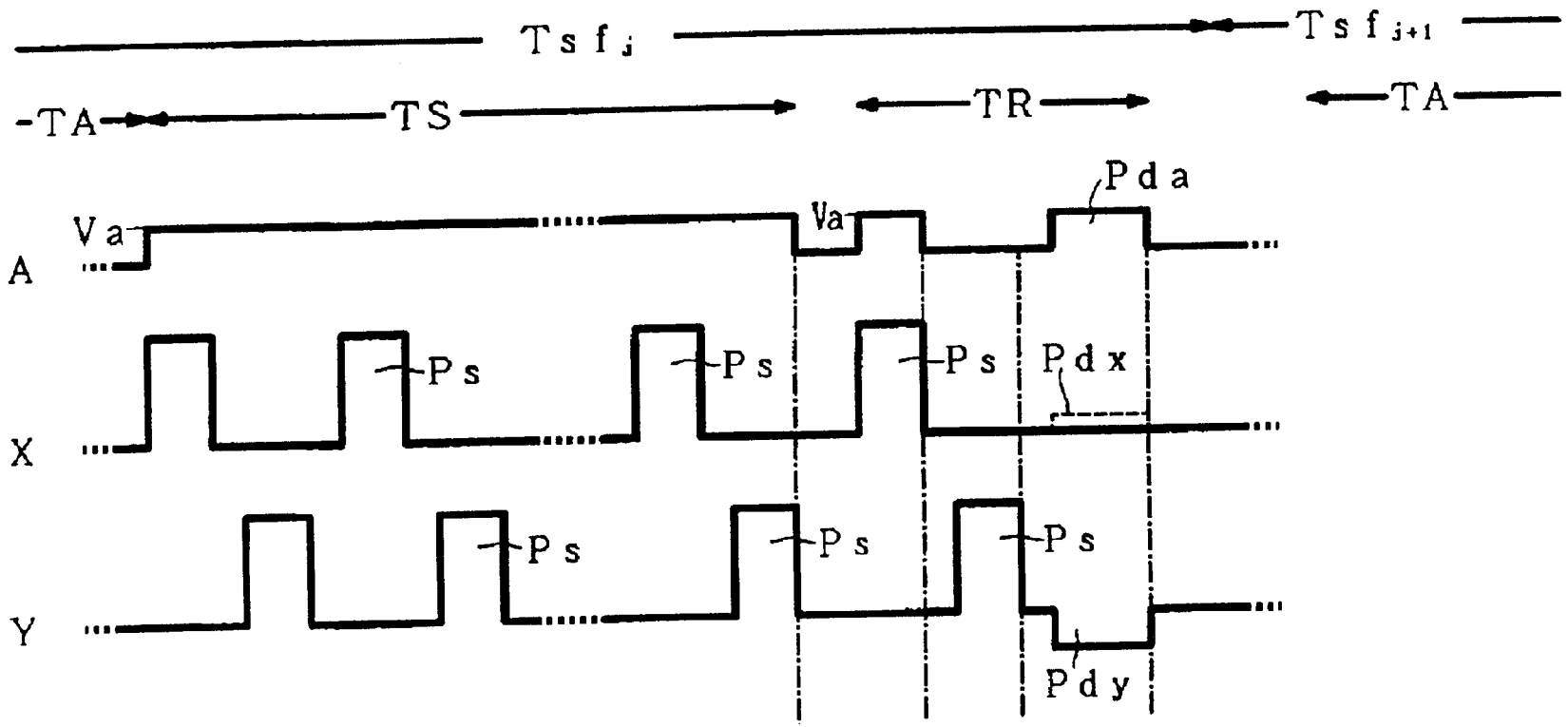
FIG. 5 shows voltage waveforms illustrating another example of the timing of initialization in a sub-frame in accordance with the present invention.

FIG. 5 shows voltage waveforms illustrating another example of the timing of initialization in the sub-frame.

The reset period TR may be provided after the sustain period TS in each of the sub-frames sf1 to sf6 and the initialization may be performed as post-treatment, as described above. In this case, the application of the sustain pulse Ps in the reset period TR can be omitted.

Figure 6:
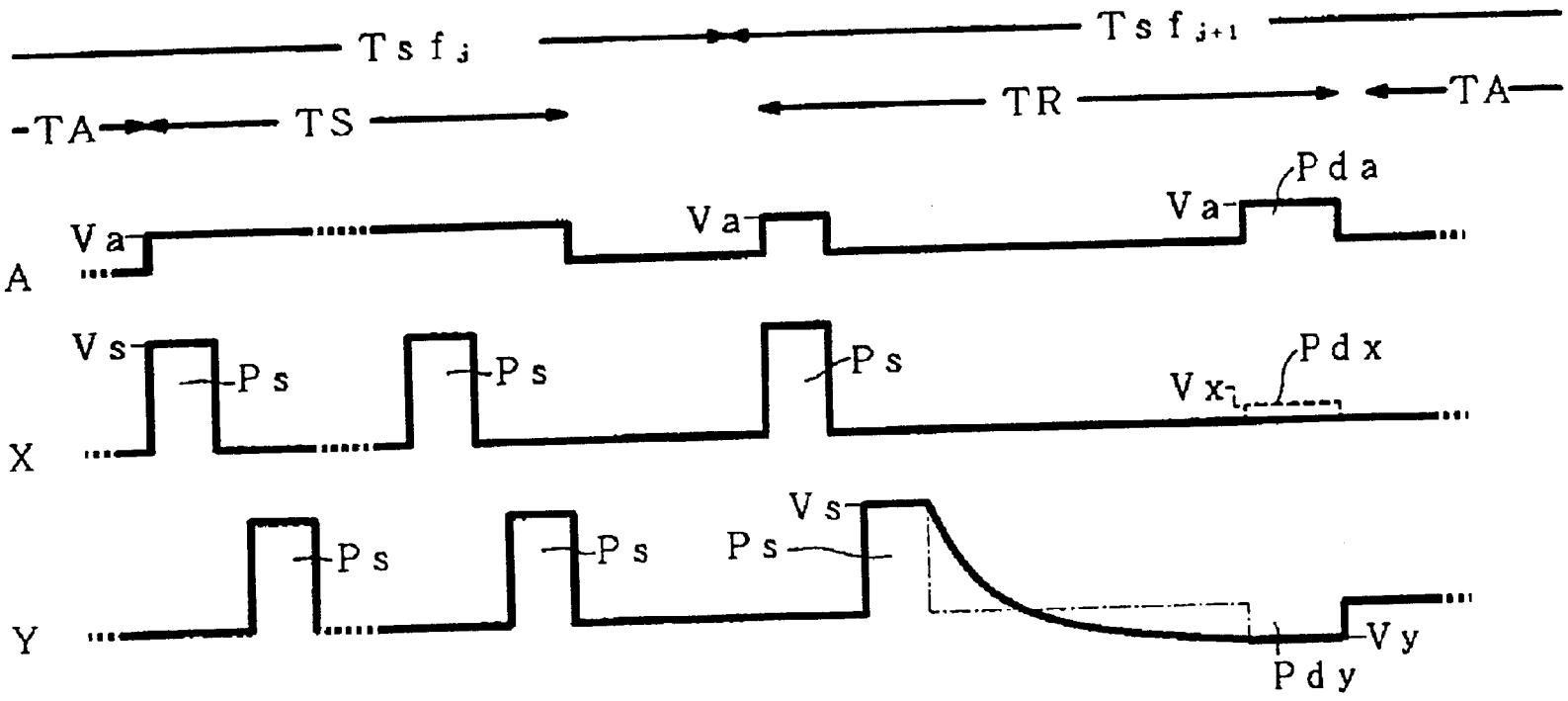
FIG. 6 shows alternative voltage waveforms.

FIG. 6 shows alternative voltage waveforms.

After the application of the sustain pulse Ps for the preparation of the wall charge in the reset period TR, the bias potential of the sustain electrodes Y is gradually shifted from the sustain pulse potential Vs to the reset pulse potential Vy. Thereby it is possible to prevent a self-discharge which is otherwise liable to take place when the potential changes quickly from the sustain pulse potential Vs to the ground potential and retain a required amount of wall charge till the application of the reset pulse Pdy.

Figure 7:
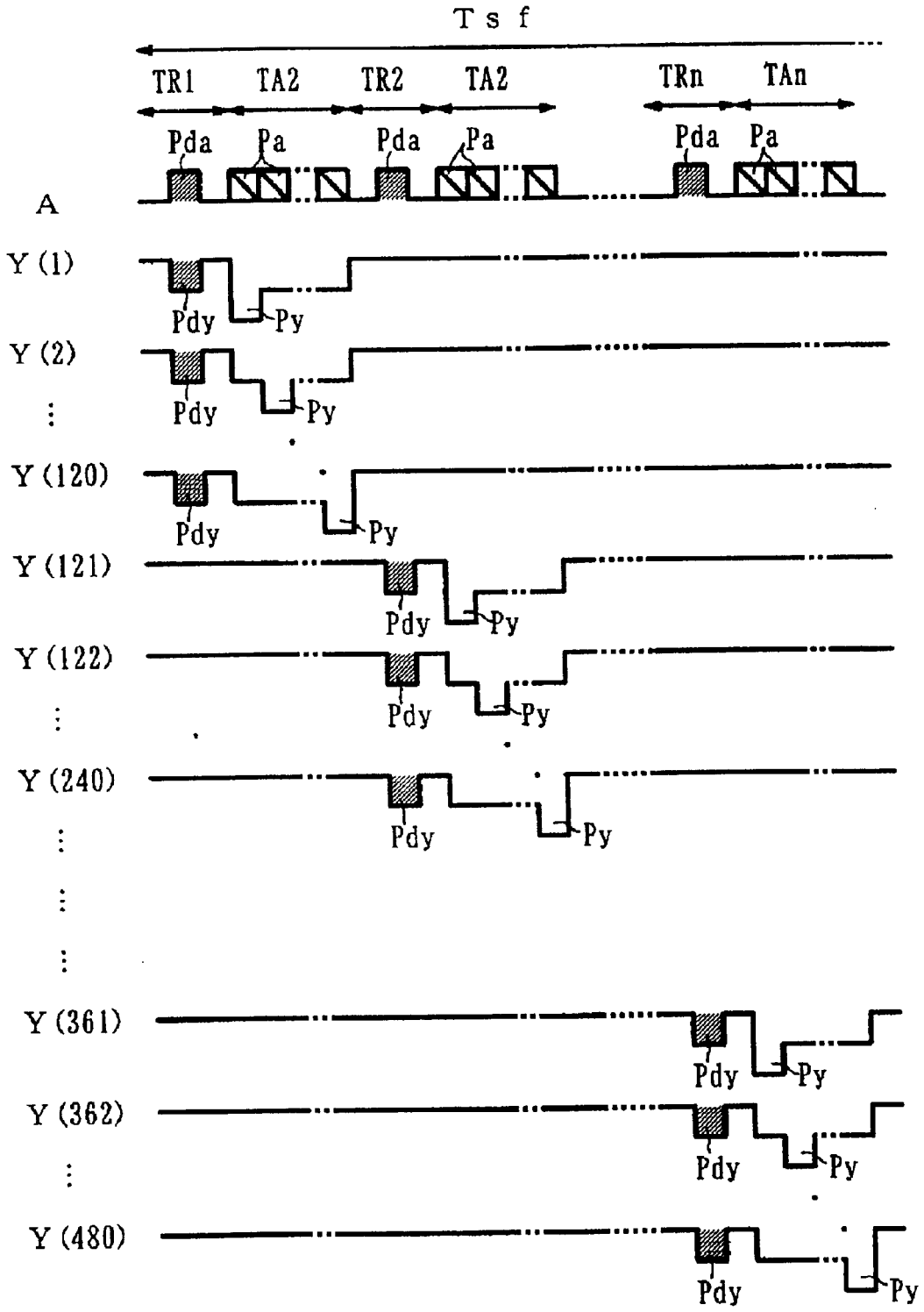
FIG. 7 shows waveforms illustrating an example of initialization in time sequence in accordance with the present invention.

FIG. 7 shows waveforms illustrating an example of initialization in time sequence.

In this example, the screen is divided into N areas ($N \geqq 2$) in the direction of the column. The initialization is carried out in time sequence for each of the areas, whereby a burden on the address driver circuit 89 can be reduced. However, more time is required for initializing the whole screen.

In the example shown in FIG. 7, the number of the rows is 480, and the initialization is performed for every area of 120 rows. The addressing may be carried out after the initialization of all the rows L is completed. However, if the initialization and the addressing are subsequently carried out for each of the areas, i.e., each of group of rows, as shown in the figure, the priming effect by the discharge for the initialization is effectively utilized for the addressing and thus an operating margin of the addressing is increased. In the case where the addressing is carried out immediately after the initialization for each of the areas, time necessary for the addressing of the entire screen does not change.

The present invention can also apply to a so-called dual scanning drive system in which the screen is divided into two areas in the direction of the row, the address electrodes A are divided so that the addressing can be carried out separately for each of the areas and the areas are driven simultaneously. In addition to the dual scanning drive system, if the screen is further divided in the direction of the column and the initialization in time sequence is carried out for each area, the load on the address driver can further be reduced.

In the above-explained examples, the address pulse Pa is set to be positive in order to reduce the deterioration of the fluorescent layers caused by the address discharge, and only one type of sustain pulse Ps of the positive polarity is applied alternately to the sustain electrode pairs in order to simplify the power source circuit. However, these examples are not limitative. The polarity of each of the reset pulses Pda, Pdx and Pdy can be selected depending on the polarities of other applied voltages so that the discharge takes place only in the precedingly selected cells by use of the residual wall charges.

According to the present invention, a complete non-charged state can be realized prior to the addressing without lighting the entire screen thereby to stabilize display.

Further, the amount of the residual charge can be adjusted to be suitable for discharge so that the intended discharge certainly occurs positively thereby to eliminate the residual charge.

Still further, the erase voltage can be lowered and thereby the load on the drive circuit can be reduced. The unnecessary self-discharge can be prevented and thereby the reliability of the initialization can be improved. Limitation on current capacity of the third electrodes and parts of the circuit for supplying power to the third electrodes can be eased and the drive circuit becomes less expensive. In addition to the eased limitation on the current capacity, the priming effect of the discharge for initializing the charge distribution can be effectively utilized for the addressing. Lastly a common power source can be used for the initialization of the charge distribution and the addressing, and thereby the drive circuit becomes less expensive.

What is claimed is:

1. A method for driving an AC-driven plasma display panel having a three-electrode surface discharge structure constructed to have a first electrode and a second electrode both extending in a direction of a row line of elements arranged in matrix and a third electrode extending in a direction of a column line of the elements, the third electrode being opposed to the first electrode and second electrode with a discharge gas space therebetween, the second electrode and the third electrode being used for addressing, the first electrode and the second electrode being used for sustaining a light-emission discharge for display, the method comprising the step of:

applying, upon displaying images in time sequence, erase voltage pulses of different polarities for erasure to the second electrode and the third electrode so that an effective voltage exceeds an opposition discharge start voltage only in the case where a wall voltage of a predetermined value or higher is superposed on the voltage pulses, during a period from the end of sustaining the light-emission discharge for display for an image to the beginning of addressing for a next image.

2. The method according to claim 1, wherein the second electrode is used as a scanning electrode to select the elements row by row and the third electrode is used as a data electrode to select the elements column by column.

3. The method according to claim 1, wherein a voltage pulse which is the same as a sustain voltage pulse for sustaining the light-emission discharge for display is applied across the first electrode and the second electrode to generate at least one surface discharge during the period prior to the application of the erase voltage pulses.

4. The method according to claim 3, wherein the at least one surface discharge is generated by, immediately before the application of the erase voltage pulse to the second electrode, applying the same voltage pulse as the sustain voltage pulse of a polarity opposite to the erase voltage pulse.

5. The method according to claim 4, wherein, after the application of the same voltage pulse as the sustain voltage pulse, the potential of the second electrode is gradually shifted from a potential biased by the application of the sustain voltage pulse to a potential biased by the application of the erase voltage pulse.

6. The method according to claim 1, wherein, at the same time as the erase voltage pulses are applied to the second electrode and the third electrode, an erase voltage pulse of the same polarity as that of the voltage pulse applied to the third electrode is applied to the first electrode.

7. The method according to claim 6, wherein the crest value of the erase voltage pulse applied to the first electrode is 0 to 60 volts, the crest value of the erase voltage pulse applied to the second electrode is −20 to −100 volts, and the crest value of the erase voltage pulse applied to the third electrode is 40 to 140 volts.

8. The method according to claim 1, wherein the display screen is divided into a plurality of areas in the direction of the column line and the application of the erase voltage pulses to the second electrode and the third electrode is carried out sequentially for each of the areas.

9. The method according to claim 8, wherein, for each of the areas, the application of the erase voltage pulses to the second electrode and the third electrode is directly followed by the addressing.

10. The method according to claim 1, wherein the crest value of the voltage pulse applied to the second electrode is equal to a voltage applied to the second electrode in a non-selected row for the addressing and the crest value of the voltage pulse applied to the third electrode is equal to a voltage applied to the third electrode for the addressing.

* * * * *